United States Patent [19]

Stanfill

[11] Patent Number: 4,848,102

[45] Date of Patent: Jul. 18, 1989

[54] ICE MAKING APPARATUS

[75] Inventor: Ted M. Stanfill, Fort Worth, Tex.

[73] Assignee: Insta-Chill, Inc., Fort Worth, Tex.

[21] Appl. No.: 162,093

[22] Filed: Feb. 29, 1988

[51] Int. Cl.[4] ..... F25C 1/00

[52] U.S. Cl. ..... 62/348; 62/188

[58] Field of Search ..... 62/348, 340, 238.5, 62/188; 165/47 B, 47 BW, 66, 139, 71

[56] References Cited

U.S. PATENT DOCUMENTS

| | | | |
|---|---|---|---|
| 2,921,447 | 1/1960 | Gottschalk | 62/348 X |
| 2,952,988 | 9/1960 | MacLeod | 62/348 X |
| 2,982,113 | 5/1961 | Pichler | 62/348 X |
| 3,004,395 | 10/1961 | Morris, Jr. | 62/348 X |
| 3,021,686 | 2/1962 | Alt | 62/348 X |
| 4,304,292 | 12/1981 | Cardone et al. | 165/47 BW |

*Primary Examiner*—Harry B. Tanner

*Attorney, Agent, or Firm*—James E. Bradley

[57] ABSTRACT

An ice making apparatus is disclosed. The ice making apparatus includes a compartment enclosing an ice cube freezing form and a refrigeration system. A fresh water reservoir within the compartment is utilized to provide water for the ice cube freezing form and a drain within the compartment removes excess fluid which results from overflow and ice melting during ice removal. An ice cube storage bin is also provided with a drain for removal of fluid from melting ice. Waste fluid from both drains is coupled to one end of one of a pair of helical concentric conduits and a source of fresh water is coupled through the other concentric conduit to the fresh water reservoir, in order that the fresh water may be substantially precooled prior to ice making. In a preferred embodiment of the present invention, an overflow reservoir is provided so that excess fluid from each drain is coupled to a waste drain.

17 Claims, 1 Drawing Sheet

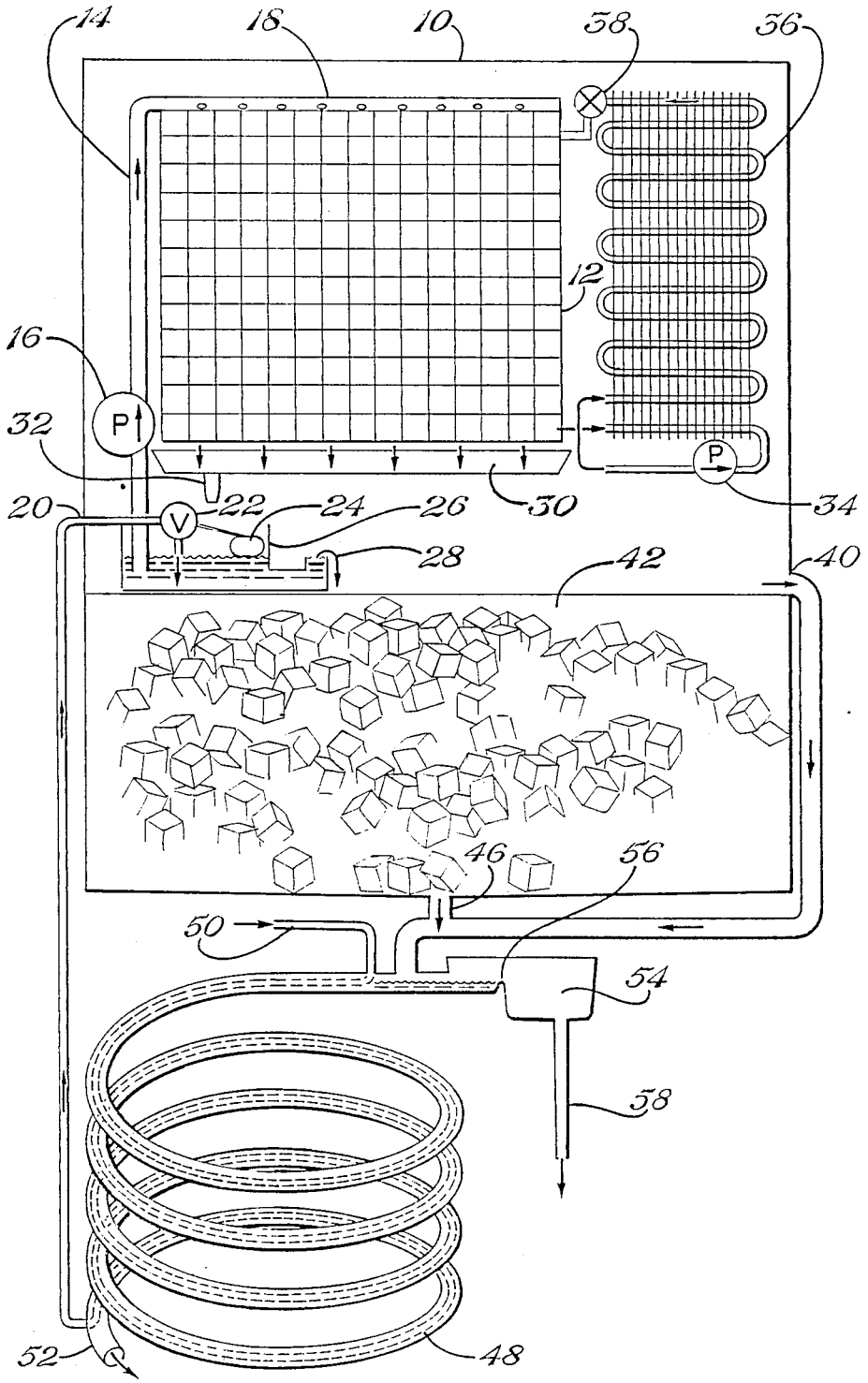
14
18
10
58
56
12
16
P
32
20
V
22
24
26
30
P
34
28
42
40
46
56
50
54
58
52
48

ICE MAKING APPARATUS

CROSS REFERENCE TO RELATED APPLICATION

This Application is being simultaneously with an U.S. patent application Ser. No. 07,162/032 filed Feb. 29, 1988 "entitled "BEVERAGE DISPENSER WITH ICE WATER PRECOOLER", inventors Ted M. Stanfill and Joe K. Dugger, which contains some common subject matter.

BACKGROUND OF THE INVENTION

1. Field of the Invention

This invention relates in general to ice making devices and in particular to ice making devices which include means for precooling the water supply utilized.

2. Description of the Prior Art

Ice making devices are well known in the prior art. Such devices generally include a refrigeration system and a hollow evaporator. Water is pumped into or over the hollow evaporator and the expansion of a refrigerant, such as freon, cools the evaporator until such time as the water freezes, causing ice to form on or in the hollow evaporator. Modern ice making devices often include provisions for reversing the flow of refrigerant temporarily in order to heat the evaporator so that ice may be easily removed. This activity generally results in a flow of highly chilled water as a result of the melting ice and this water must be removed or recycled.

Known ice making devices also generally include an ice cube storage bin. Typically not refrigerated, the ice within the storage bin eventually melts, generating another source of chilled waste water. This chilled waste water must be coupled to a waste drain, periodically removed, or, as disclosed in recent patents, recycled to make additional ice.

In previously known ice making devices the period of time necessary to freeze a load of ice is generally determined by measurement of water temperature in the ice freezing form or, by the lapse of a fixed period of time. A key factor in the amount of time necessary to freeze a fixed quantity of water is the temperature of the water source utilized. In certain southern locations of the United States it is not uncommon for fresh water supplies to reach 84°-86° Fahrenheit during summer months. Studies have shown that by lowering the temperature of the input water source to 50° Fahrenheit an ice making device will produce approximately sixty percent more ice.

It should therefore be apparent that a need exists for an improved ice making device which includes a provision for precooling the water supply.

SUMMARY OF THE INVENTION

It therefore one object of the present invention to provide an improved ice making device.

It is another object of the present invention to provide an improved ice making device which includes means for precooling the water supply.

It is yet another object of the present invention to provide an improved ice making device which includes means for precooling the water supply while controlling the drainage of waste water.

The foregoing objects are achieved as is now described. The ice making apparatus of the present invention includes a compartment which incloses an ice cube freezing form and a refrigeration system. A fresh water reservoir within the compartment is utilized to provide fluid for the ice cube freezing form and a drain within the compartment removes fluid which results from ice melting during removal. An ice cube storage bin is also provided with a drain for removal of fluid from melting ice. Waste fluid from both drains is coupled to one end of a pair of helical concentric conduits and a source of fresh water is coupled through the other concentric conduit to the fresh water reservoir, in order that the fresh water may be substantially precooled prior to ice making. In a preferred embodiment of the present invention, an overflow reservoir is provided so that excess fluid from each drain is coupled to a waste drain other than backing up into the ice storage bin.

The above as well as additional objects, features, and advantages of the invention will become apparent in the following detailed description.

BRIEF DESCRIPTION OF THE DRAWING

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the sole figure, wherein:

The FIGURE is depicts a partially schematic view of the ice making apparatus of the present invention.

DETAILED DESCRIPTION OF THE INVENTION

With reference now to the sole FIGURE, there is depicted a partially schematic view of the ice making apparatus of the present invention. As can be seen, the ice making apparatus includes a compartment 10 constructed of a plurality of walls manufactured utilizing any suitable or conventional insulating material. Compartment 10 preferably encloses ice cube freezing form 12 which, in a manner Well known in the art, comprises a hollow evaporator constructed of cast aluminum or other metallic material. Fresh water is pumped into ice cube freezing form 12 utilizing water pump 16 and water supply conduit 14 which is connected to water supply manifold 18. Utilizing a plurality of apertures within water supply manifold 18, a supply of fresh water is permitted to flow onto ice cube freezing form 12.

Fresh water is coupled into compartment 10 via fresh water inlet 20. The flow of fresh water into compartment 10 is controlled by a float actuated supply valve 22 which, in conjunction with float 24, is utilized in a manner well known in the art to maintain a selected level of water within fresh water reservoir 26. As can be seen, fresh water reservoir 26 also includes reservoir overflow 28 which permits excess water within fresh water reservoir 26 to flow onto the bottom of compartment 10 and out through drain 40 to be utilized in a manner which will be explained in greater detail herein.

As is typical in ice cube making devices, a refrigeration system is associated with compartment 10. The refrigeration system preferably includes a compressor 34, which serves to compress a refrigerant, such as freon, into a fluid which is then cooled in any manner known in the art within condenser coil 36. Expansion valve 38 is utilized to permit the pressurized fluid within condenser coil 36 to expand into a gaseous state into a plurality of hollow recesses (not shown), within ice cube freezing form 12, cooling ice cube freezing form 12 to the point where water will freeze within the recesses provided.

After ice has been formed within ice cube freezing form 12, as indicated by a temperature sensing device (not shown), the ice making apparatus of the present invention will remove the ice by controlling the operation of compressor 34 in order to reverse the flow of refrigerant within the refrigeration system, causing ice cube freezing form 12 to be heated, aiding in the removal of ice cubes from the recesses provided therein.

Excess water which flows through ice cube freezing form 12 during the fill operation and chilled water resultant from melting ice within the recesses of ice cube freezing form 12 during ice removal is preferably collected within runoff water tray 30. As is depicted in the FIGURE, runoff water tray 30 includes a drain 32 which permits the collected chilled water which drips from ice cube freezing form 12 to be returned to fresh water reservoir 26. In this manner the temperature of the water within fresh water reservoir 26 may be appreciably lowered.

Those skilled in the ice cube making art will appreciate that the flow of chilled waste water from runoff water tray 30 will increase dramatically during those periods of time when ice cube freezing form 12 is being cycled through an empty and fill state. Thus, it should be apparent that a large amount of chilled water will be drained into fresh water reservoir 26 through drain 32 and will overflow via reservoir overflow 28 into the bottom of compartment 10 to be removed Via compartment drain 40.

Disposed beneath compartment 10 is ice cube storage bin 42 which is preferably an insulated compartment utilized for the storage of mass quantities of ice cubes 44. Inasmuch as ice cube storage bin 42 is not refrigerated, ice 44 will eventually melt, generating a second source of chilled waste water which will be removed from ice cube storage bin 42 via ice cube storage bin drain 46.

Still referring to the FIGURE, it can be seen that the chilled waste water coupled through compartment drain 40 and ice cube storage drain 46 is coupled to helical concentric coil 48. In a preferred embodiment of the present invention, the chilled waste water thus generated is coupled to one end of outer conduit 52 and flows in a helical manner through outer conduit 52 to a waste drain. Preferably, one end of inner conduit 50 is coupled to a supply of fresh water which flows through inner conduit 50 to fresh water inlet 20. In this manner, the temperature of the fresh water supply coupled through inner conduit 50 may be substantially cooled to aid in the efficiency of the ice making operation.

Those ordinarily skilled in the ice making art will appreciate that the above described system will be effective to precool a water supply to enhance the ice making operations; however, the vast quantities of chilled waste water generated during the empty and fill cycle of ice cube freezing form 12 will exceed the amount of water which may flow through outer conduit 52 in a short period of time. Without provision for handling this excess flow the chilled waste water flowing from compartment drain 40 and ice cube storage bin drain 46 will generally backup into ice cube storage bin 42, mixing with ice 44 and generally rendering ice 44 unusable.

Therefore, in a preferred embodiment of the present invention, compartment drain 40 and ice cube storage bin drain 46 are both coupled simultaneously to outer conduit 52 and overflow reservoir 54. As can be seen, overflow reservoir 54 includes a weir 56 which will retain a small amount of chilled waste water in one section of overflow reservoir 54. As the amount of chilled waste water from compartment drain 40 and ice cube storage bin drain 46 exceeds the flow capability of outer conduit 52, the level of chilled waste water within overflow reservoir 54 will exceed the level of weir 56 and will be drained via waste drain 58. In this manner, the ice making apparatus of the present invention may rapidly and efficiently precool the fresh water source to enhance the efficiency of the ice making operation and yet will accommodate the periodic excessive flow of chilled waste water from the apparatus so that the storage of ice 44 is not contaminated by backflow of chilled waste water Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An ice making apparatus comprising:

a cabinet having a compartment therein, said compartment having a first drain for removing excess fluid;

an ice cube freezing form disposed within said compartment;

a refrigeration system associated with said cabinet for chilling said ice cube freezing form;

a fresh water inlet within said compartment;

means for selectively coupling fresh water from said fresh water inlet to said ice cube freezing form;

an ice cube storage bin associated with said cabinet, said bin having a second drain for removing excess fluid from melting ice;

a length of concentric tubing having an inner conduit substantially concentrically disposed within an outer conduit;

means directly coupling said first drain and said second drain to a first end of a first of said concentric conduits at a location external to said ice cube storage bin;

means coupling a source of fresh water to a first end of a second of said concentric conduits; and means coupling a second end of said second concentric conduit to said fresh water inlet wherein said fresh water is precooled prior to entry into said ice making apparatus.

2. The ice making apparatus according to claim 1 wherein said means for selectively coupling fresh water from said fresh water inlet to said ice cube freezing form includes a reservoir for storing a quantity of fresh water within said compartment.

3. The ice making apparatus according to claim 2 further including means for maintaining a minimum level of fresh water within said reservoir.

4. The ice making apparatus according to claim 3 wherein said means for maintaining a minimum level of fresh water within said reservoir comprises a float actuated valve.

5. The ice making apparatus according to claim 1 wherein said ice cube storage bin is disposed substantially under said compartment.

6. The ice making apparatus according to claim 1 wherein at least a portion of said length of concentric tubing is helical in shape.

7. The ice making apparatus according to claim 6 wherein said first drain and said second drain are coupled to a first end of said outer conduit.

8. The ice making apparatus according to claim 1 wherein said source of fresh water is coupled to a first end of said inner conduit.

9. An ice making apparatus comprising:

a cabinet having a compartment therein, said compartment having a first drain for removing excess fluid;

an ice cube freezing form disposed within said compartment;

a refrigeration system associated with said cabinet for chilling said ice cube freezing form;

a fresh water inlet within said compartment;

means for selectively coupling fresh water from said fresh water inlet to said ice cube freezing form;

an ice cube storage bin associated with said cabinet, said bin having a second drain for removing excess fluid from melting ice;

a length of concentric tubing having an inner conduit substantially concentrically disposed within an outer conduit;

means coupling said first drain and said second drain to a first end of a first of said concentric conduits;

overflow means coupled to a first end of said first concentric conduit for coupling excess fluid to a waste drain when said excess fluid from said first drain and said second drain exceeds a predetermined amount;

means coupling a source of fresh water to a first end of a second of said concentric conduits; and means coupling a second end of said second concentric conduit to said fresh water inlet wherein said fresh water is precooled prior to entry into said ice making apparatus.

10. The ice making apparatus according to claim 9 wherein said overflow means comprises a reservoir having a weir and a drain therein wherein fluid will flow out through said drain whenever the fluid level within said reservoir exceeds the level of said weir.

11. The ice making apparatus according to claim 9 wherein said means for selectively coupling fresh water from said fresh water inlet to said ice cube freezing form includes a reservoir for storing a quantity of fresh water within said compartment.

12. The ice making apparatus according to claim 11 further including means for maintaining a minimum level of fresh water within said reservoir.

13. The ice making apparatus according to claim 12 wherein said means for maintaining a minimum level of fresh water within said reservoir comprises a float actuated valve.

14. The ice making apparatus according to claim 9 wherein said ice cube storage bin is disposed substantially under said compartment.

15. The ice making apparatus according to claim 9 wherein at least a portion of said length of concentric tubing is helical in shape.

16. The ice making apparatus according to claim 15 wherein said first drain and said second drain are coupled to a first end of said outer conduit.

17. The ice making apparatus according to claim 9 wherein said source of fresh water is coupled to a first end of said inner conduit.

* * * * *